United States Patent [19]

Burgher et al.

[11] Patent Number: 5,022,330

[45] Date of Patent: Jun. 11, 1991

[54] GARBAGE MELTER

[76] Inventors: Stephen K. Burgher, 7266 Amboy Rd., Staten Island, N.Y. 10307; George Spector, 233 Broadway, New York, N.Y. 10007

[21] Appl. No.: 582,659

[22] Filed: Sep. 12, 1990

[51] Int. Cl.[5] ..... F23G 5/00

[52] U.S. Cl. ..... 110/235; 110/216; 110/223; 110/234; 110/248; 110/259

[58] Field of Search ..... 110/235, 248, 259, 215, 110/216, 223, 234, 171

[56] References Cited

U.S. PATENT DOCUMENTS

| | | | |
|---|---|---|---|
| 2,367,590 | 1/1945 | Lewers et al. | 110/248 |
| 3,932,280 | 1/1976 | Anderson | 110/259 |
| 4,502,397 | 3/1985 | Hochmuth | 110/234 |
| 4,574,710 | 3/1986 | Pickard | 110/223 |
| 4,579,069 | 4/1986 | Gray et al. | 110/216 |
| 4,724,776 | 2/1988 | Foresto | 110/248 |
| 4,785,744 | 11/1988 | Fontaine | 110/235 |
| 4,829,911 | 5/1989 | Nielson | 110/259 |
| 4,898,105 | 2/1990 | Rappoldt et al. | 110/216 |
| 4,932,334 | 6/1990 | Patte et al. | 110/216 |
| 4,932,336 | 6/1990 | Srowig et al. | 110/234 |

*Primary Examiner*—Henry C. Yuen

[57] ABSTRACT

A garbage burning and melting apparatus is provided and consists of a modified blast furnace to burn coal and garbage therein so that molten slag and lava by products can be extracted therefrom into a conveyor while the exhaust can be filtered to remove powdered ash therefrom.

2 Claims, 1 Drawing Sheet

GARBAGE MELTER

BACKGROUND OF THE INVENTION

The instant invention relates generally to incinerators and more specifically it relates to a garbage burning and melting apparatus which provides a super heated blast furnace which will break down all the impurities in the garbage by burning and melting to reduce volume of residue.

There are available various conventional incinerators which do not provide the novel improvements of the invention herein disclosed.

SUMMARY OF THE INVENTION

A primary object of the present invention is to provide a garbage burning and melting apparatus that will overcome the shortcomings of the prior art devices.

Another object is to provide a garbage burning and melting apparatus in which a super heated blast furnace will break down all the impurities in the garbage so that the result will be that no negative impurities will be allowed to enter the atmosphere and reduce volume of residue.

An additional object is to provide a garbage burning and melting apparatus in which the by-products from the system will be filtered and drained off to be disposed of for a better disposal of the garbage by-products.

A further object is to provide a garbage burning and melting apparatus that is simple and easy to use.

A still further object is to provide a garbage burning and melting apparatus that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a diagrammatic elevational view partly in section with parts broken away showing a garbage burning and melting apparatus incorporating a modified blast furnace wherein molten slag and lava are recovered at the furnace bottom and transported away on a conveyor belt. The molten lava and slag is water cooled and the exhaust is filtered at the furnace top and powder ash is recovered.

DETAILED DESCRIPTION OF THE PREFERRED EMBODIMENTS

Figure 1:
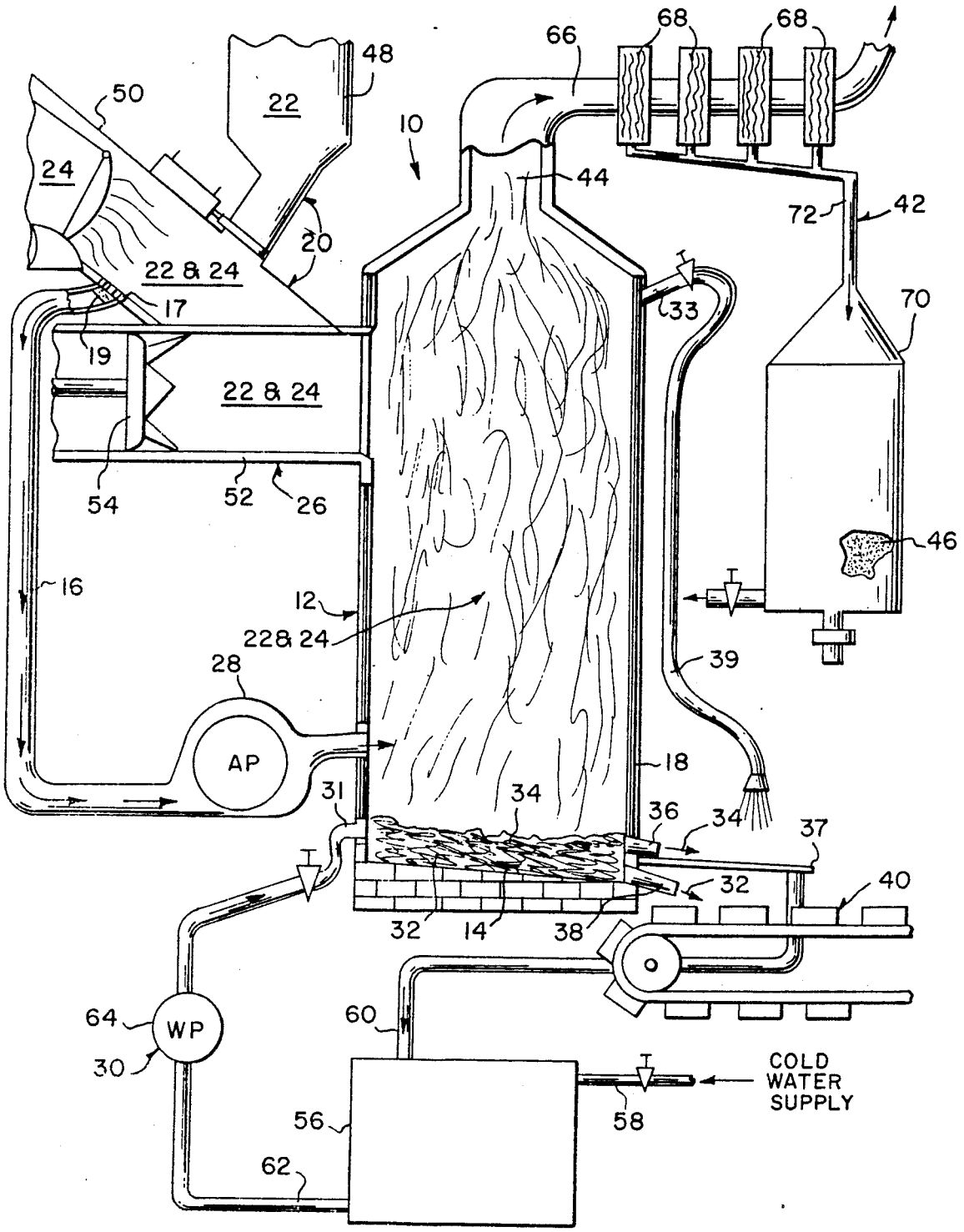

Turning now descriptively to the drawings, in which similar reference characters denote similar elements throughout the several views, FIG. 1 illustrates a garbage burning and melting apparatus 10 consisting of a modified blast furnace 12 having channeled side walls 18 and a sloping fire brick bottom floor 14. A first chamber 20 is for mixing coal 22 and garbage 24 together, while a second chamber 26 is for holding and loading the mixed coal 22 and garbage 24 from the first chamber 20 into the blast furnace 12 for burning.

A hot air pump 28 fluidly extends between the second chamber 26 and the blast furnace 125 for forcing a blast of hot air into the furnace 12 at the low end of the blast furnace to produce the intense heat needed to burn the coal 225 and the garbage 24 above the bottom floor 14. A conduit 16 is connected between the air pump 28 and a grate 17 in the first chamber 20. A filter 19 is carried in the conduit 16 below the grate 17 so that the air pump 28 can remove obnoxious odors from the first chamber 20, and send the odors into the blast furnace 12. A mechanism 30 is for cooling the walls 18 of the blast furnace 12, with cool water entering an inlet pipe 31 and exiting an outlet pipe 33 in the blast furnace 12. Tapping is done when molten lava 32 and slag 34 reach a prescribed height. This molten lava 32 and slag 34 is removed through exit ports 36 and 38 at the low sides of the bottom floor 14 and with the slag 34 then washed in a water trough 37 from a hose 39 connected to the outlet pipe 33. A conveyor 40 is located at the exit pors 36 and 38 for conveying the melted lava 32 and slag 34 by-products away from the blast furnace 12 for distribution. Another mechanism 42 is for filtering the exhausted gases 44 from the top of the blast furnace 12 to remove powdered ash 46 therefrom.

The first chamber 20 includes a pair of sloping intersecting conduits 48 and 50 in which one conduit 48 carries the coal 22 therein and the other conduit 50 carries the garbage 24 therein to be mixed together. The second chamber 26 includes a tank 52 for holding the mixed coal 22 and garbage 24 and a ram rod 54 for loading the mixed coal 22 and garbage 24 into the blast furnace 12.

The cooling mechanism 30 includes a water reservoir 56 having two inlet pipes 58, 60 and an outlet pipe 62. The first inlet pipe 58 is connected to a cold water supply while the second inlet pipe 60 is connected to the water trough 37 to carry hot water sprayed from the hose 39 back into the water reservoir 56. A water pump 64 is fluidly connected between the outlet pipe 62 of the water reservoir 56 and the inlet pipe 31 of the blast furnace 12. Water rapidly exits the top of the blast furnace 12 through the outlet pipe 33, carrying the extensive heat away from inside the side walls 18 of the blast furnace 12.

The filtering mechanism 42 inlcudes a flue 66 at the top of the blast furnace 12 with a plurality of spaced apart filters 68 carried on the flue 66 to remove various impurities from the gases 44 exiting therefrom. A collector 70 is fluidly connected at 72 to each of the filters 68 to remove the powdered ash 46 from the filters 68. Smoke scrubbers may be used with the filters.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A garbage burning and melting apparatus comprising:

(a) a modified blast furnace having channeled side walls and a sloping fire brick bottom floor;

(b) a first chamber for mixing coal and garbage together;

(c) a second chamber for holding and loading the mixed coal and garbage from said first chamber into said blast furnace for burning;

(d) a hot air pump fluidly extending between said second chamber and said blast furnace for removing obnoxious odors from said second chamber and forcing a blast of hot air into said furnace at the low end of said blast furnace to produce the intense heat needed to burn the coal and garbage above the bottom floor;

(e) means for cooling the side walls of said blast furnace with cool water entering an inlet pipe and exiting an outlet pipe in said blast furnace;

(f) means for washing molten slag outside said blast furnace after the slag and lava leave through exit ports at the low sides of the bottom floor;

(g) a conveyor located at the exit ports for conveying the molten slag and lava by-products away from said blast furnace for distribution;

(h) means for filtering the exhausted gases from the top of said blast furnace to remove powdered ash therefrom in combination with scrubbers;

(i) said first chamber includes a pair of sloping intersecting conduits in which one said conduit carries the coal therein and the other conduit carries the garbage therein to mixed together;

(j) said second chamber includes a tank for holding the mixed coal and garbage and ram rod for loading the mixed coal and garbage into said blast furnace; and (k) said washing means includes a water reservoir having two inlet pipes and an outlet pipe, whereby the first inlet pipe is connected to a cold water supply, while the second inlet pipe is provided for carrying water that exits through the outlet pipe from said blast furnace back into said water reservoir; and a water pump fluidly connected between the outlet pipe of said water reservoir and the inlet pipe in said blast furnace so as to cool the side walls of said blast furnace.

2. A garbage burning and melting apparatus as recited in claim 1, wherein said filtering means includes:

(a) a flue at the top of said blast furnace;

(b) a plurality of spaced apart filters carried in said flue to remove various impurities from the gases exiting therefrom; and (c) a collector fluidly connected to each of said filters to remove the powdered ash from said filters.

* * * * *